US006259091B1

(12) United States Patent
Eiden et al.

(10) Patent No.: US 6,259,091 B1
(45) **Date of Patent: *Jul. 10, 2001**

(54) APPARATUS FOR REDUCTION OF SELECTED ION INTENSITIES IN CONFINED ION BEAMS

(75) Inventors: Gregory C. Eiden; Charles J. Barinaga; David W. Koppenaal, all of Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/097,995

(22) Filed: Jun. 15, 1998

Related U.S. Application Data

(63) Continuation-in-part of application No. 08/583,324, filed on Jan. 5, 1996, now Pat. No. 5,767,512.

(51) Int. Cl.[7] ..... H01J 49/00

(52) U.S. Cl. ..... 250/281; 250/288; 250/423 R

(58) Field of Search ..... 250/281, 282, 250/288, 423 R

(56) References Cited

U.S. PATENT DOCUMENTS

| | | | | |
|---|---|---|---|---|
| 4,037,100 | * | 7/1977 | Purser | 250/281 |
| 4,948,962 | | 8/1990 | Mitsui et al. . | |
| 4,963,736 | | 10/1990 | Douglas et al. . | |
| 5,049,739 | | 9/1991 | Okamoto | 250/281 |
| 5,120,956 | | 6/1992 | Purser . | |
| 5,237,174 | * | 8/1993 | Purser | 250/281 |
| 5,248,875 | * | 9/1993 | Douglas et al. | 250/281 |
| 5,289,010 | | 2/1994 | Shohet . | |
| 5,313,067 | | 5/1994 | Houk et al. . | |
| 5,396,064 | | 3/1995 | Wells . | |
| 5,767,512 | * | 6/1998 | Eiden et al. | 250/282 |

FOREIGN PATENT DOCUMENTS

| | | |
|---|---|---|
| 0 813 228 A1 | 5/1997 | (EP) . |
| WO 97/25737 | 7/1997 | (WO) . |

OTHER PUBLICATIONS

"Performance of an Ion Trap Inductively Coupled Plasma Mass Spectrometer", DW Koppenaal, CJ Barinaga, and MR Smith, J. Analytical Atomic Spectrometry vol. 9, pp. 1053–1058 (1994).

"Ion–Trap Mass Spectrometry with an Inductively Coupled Plasma Source", CJ Barinaga and DW Koppenaal, Rapid Communications in Mass Spectrometry, vol. 8, pp. 71–76 (1994).

"Effects of hydrogen mixed with argon carrier gas in electrothermal vaporization–ICP/MS" by N Shibata, N Fudagawa and M Kubota, Spectrochimica Acta vol. 47B, pp. 505–516 (1992).

"Dissociation of analyte oxide ions in inductively coupled plasma mass spectrometry", by E Poussel, MJ Mermet, and D Deruaz, J. of Analytical Atomic Spectrometry vol. 9, pp. 61–66 (1994).

(List continued on next page.)

*Primary Examiner*—Kiet T. Nguyen
(74) *Attorney, Agent, or Firm*—Paul W. Zimmerman

(57) ABSTRACT

An apparatus for producing an ion beam having an increased proportion of analyte ions compared to carrier gas ions is disclosed. Specifically, the apparatus has an ion trap or a collision cell containing a reagent gas wherein the reagent gas accepts charge from the analyte ions thereby selectively neutralizing the carrier gas ions. Also disclosed is the collision cell as employed in various locations within analytical instruments including an inductively coupled plasma mass spectrometer.

22 Claims, 10 Drawing Sheets

OTHER PUBLICATIONS

"Use of Nitrogen and Hydrogen in ICP/MS" by H Louie and SY–P Soo, J. of Analytical Atomic Spectrometry vol. 7, pp. 557–564 (1992).

PE Walters and CA Barnardt, Spectrochimica Acta 43B, pp. 325–337 (1988).

"Alternatives to all–argon plasma in inductively coupled plasma mass spectrometry (ICP–MS): an overview", by SF Durrant, Fresenius J. Analytical Chemistry 347, pp. 389–392 (1993).

"Fast atom bombardment of solids as an ion source in mass spectrometry", M Barber, RS Bordoli, RD Sedgwick, and AN Tyler, Nature vol. 293, pp. 270–275, Sep. 24, 1981.

"Radio–frequency Glow Discharge Ion Trap Mass spectrometry", by SA McLuckey and GL Glish, Anal. Chem. vol. 64, pp. 1606–1609, 1992.

* cited by examiner-

APPARATUS FOR REDUCTION OF SELECTED ION INTENSITIES IN CONFINED ION BEAMS

This application is a continuation-in-part of application Ser. No. 08/583,324, filed Jan. 5, 1996, now U.S. Pat. No. 5,767,512.

This invention was made with Government support under Contract DE-AC06-76RLO 1830 awarded by the U.S. Department of Energy. The Government has certain rights in the invention.

FIELD OF THE INVENTION

The present invention relates generally to an apparatus for producing an ion beam having an increased proportion of analyte ions compared to carrier gas ions. More specifically, the apparatus is an ion source coupled to a collision cell or to an ion trap containing a selectively reactive gas.

BACKGROUND OF THE INVENTION

Many analytical or industrial processes require the generation of beams of ions of particular substances or analytes. For example, ion beams might occur in ion guns, ion implanters, ion thrusters for attitude control of satellites, laser ablation plumes, and various mass spectrometers (MS), including linear quadrupole MS, quadrupole ion trap MS (e.g. "Paul" trap), ion cyclotron resonance MS, time-of-flight MS, and electric and/or magnetic sector MS. Several schemes are known in the art for generating such ion beams including electron impact, laser irradiation, electrospray, and variations thereof such as Ionspray™, thermospray, inductively coupled plasma sources, glow discharges and hollow cathode discharges. Typical arrangements combine a sample with a carrier or support gas whereby the carrier gas is utilized to aid in transporting, ionizing, or both transporting and ionizing, the sample. As is well known, analyte substances often occur in combination with other substances which can also be ionized and transported along with the analyte ions and carrier gas ions. These other substances will be collectively referred to as matrix substances, or in ionized form as matrix ions. The combined form of analyte and matrix will be referred to as the sample, or in ionized form as sample ions. Thus, matrix refers to all substances in a sample apart from the analyte. Similarly, matrix ions refers to all ions apart from the analyte ions and thus, matrix ions includes plasma ions. For example, when an aqueous nitric acid sample is introduced into an argon ICP, plasma ions such as $ArH^+$, $ArO^+$, $ArN^+$ are formed. The matrix ions are typically an interference in chemical analysis applications or other utilizations of the plasma or ion beam.

For example, in a typical arrangement a sample is combined with the carrier gas in an electrical field, whereupon the sample and the carrier gas are ionized in a strong electric or magnetic field and later used in an analytical or other process. In another typical arrangement, the carrier gas is first ionized in a strong electric or magnetic field whereupon the sample is then introduced into the ionized carrier gas. Ionized carrier gas contains carrier gas and carrier gas ions. Electric fields are generated by a variety of methods well known in the art including, but not limited to, capacitive and inductive coupling of radiofrequency (RF) and/or DC electrical energy.

In an inductive coupling arrangement, an RF voltage is applied to a coil of a conducting material, typically brass. In the interior of the coil, one or more tubes supply a carrier gas, such as argon, and a sample, which may be any substance or mixture of substances. The analyte may be supplied in a variety of forms including but not limited to a gaseous form, as a liquid, as a droplet form, as an aerosol, or as a laser ablated plume. A large electrical field is generated within the coil. Within this field, any free electrons will initiate a chain reaction in the sample and the carrier gas causing a loss of electrons and thus ionization of the carrier gas and the sample. Several methods well known in the art, including but not limited to the introduction of a Tesla coil, the introduction of a graphite rod, or thermal emission of electrons, will provide free electrons causing initiation of a chain reaction. The result is an ionized gas or plasma consisting of both free electrons and charged and uncharged species of the carrier gas and the sample. The species of both the carrier gas and the sample in the plasma may be in the form of particles, atoms or molecules, or a mixture of particles, atoms and molecules, depending on the particular species selected for use as the carrier gas and the species and form selected for use as the sample.

The carrier gas and the sample may be combined by a wide variety of methods well known in the art. For example, as described above, the sample in an aerosol form is combined with the carrier gas and directed to the interior of a coil in an inductively coupled plasma. Another typical arrangement, known in the art as electrospray (and variations thereof such as ionspray™), employs a needle which receives a liquid sample from a source such as a liquid chromatograph. Surrounding the needle is a tube which supplies a carrier gas such as nitrogen as a high velocity atomizing carrier gas. Both the needle and the tube empty into a chamber. Upon discharge from the needle, the sample liquid is evaporated and atomized in the nitrogen carrier gas. Ions of both the evaporated liquid sample and the nitrogen carrier gas are produced by creating an electric field within the chamber. The electric field may be produced by creating a voltage difference between the needle and the chamber. A voltage difference may be created by applying a voltage to the needle and grounding the chamber.

The resultant plasma generated by any of the foregoing methods is typically directed towards either an analytical apparatus or towards a reaction zone wherein the carrier gas and sample ions are analyzed or otherwise reacted or utilized in some fashion. The resultant plasma is typically directed by means of an electric or magnetic field, or by means of a pressure differential, or both. As the plasma is directed, the plasma is converted from a plasma to an ion beam. As used herein, the term "ion beam" refers to a stream consisting primarily of positively charged and neutral species. The bulk of the negatively charged species in the plasma are typically electrons, which are rapidly dispersed as the plasma is directed by either electric or magnetic fields or by a pressure differential. However, even after significant dispersal of the ion beam, the ion beam may not be completely void of negatively charged species. As the plasma progresses forward, the free electrons, due to their low mass relative to the positively charged ions, tend to disperse from the plasma, thus converting the plasma to an ion beam. Also, the ion beam itself will tend to disperse due to several effects. Most prominent among these effects are free jet expansion and the repulsive forces of charged species within the ion beam. The effect of dispersion of the constituent species in the ion beam is charge separation among those species and is well known in the art. The resultant ion beam is thus typically characterized by high net positive charge density. Since the carrier gas is typically present in excess over the sample, this high positive charge density is primarily attributable to the relatively high abundance of positively charged carrier gas ions.

In many applications, the abundance of positively charged carrier gas ions, matrix io ions and/or the resultant high charge density may be undesirable. For example, it is often desirable that the ion beam be focused through a small aperture, for example, if the sample ions were to be analyzed in a mass spectrometer. In such an arrangement, where the ion beam is directed through an aperture, the high charge density will prescribe a space charge limit to the maximum on beam current that may be passed through a given aperture. Any beam current in excess of the space charge limit is unable to pass through the aperture and is thus lost. In many applications, the portion of the beam which is lost includes analyte ions. Indeed, a loss of a portion of the beam may result in a disproportionate loss of some or all of the analyte ions because the analyte ions may not be evenly distributed throughout the ion beam or may not respond to the various dispersing and directing forces in the same manner as the carrier gas or matrix ions.

Another example where the presence of carrier gas or matrix ions is undesirable is in a quadrupole ion trap mass spectrometer where the quadrupole ion trap has a limited ion storage capacity. In an ion beam directed into a quadrupole ion trap, the carrier gas and matrix ions compete with analyte ions for the limited storage capacity of the quadrupole ion trap. Thus, to the extent that carrier gas ions or matrix ions can be selectively eliminated from the ion beam, the storage capacity for analyte ions in the quadrupole ion trap is thereby increased. Carrier gas ions and plasma ions can be potent chemical ionization sources and can cause high levels of ionization of background gases in the trap. Such background ions can be formed in sufficient number that they interfere with the detection of analyte ions even if good vacuum practices and high vacuum conditions are maintained. Thus, removal of carrier gas ions and/or plasma ions also has the beneficial effect of reducing such background ionization.

The presence of carrier gas or matrix ions is also undesirable in any application where the analyte ions are to be used in a process or reaction where the carrier gas or matrix ions might interfere with such process. By way of further example, in many integrated circuit manufacturing processes, ion beams may be directed towards a targeted material such as a silicon wafer to impart electrical or physical properties to the material. The desired properties are typically highly dependent on the specific ions directed at such materials. Thus, carrier gas or matrix ions may cause undesirable effects if implanted in the targeted materials.

Thus, in an ion beam having carrier gas ions, analyte ions, and/or matrix ions, there exists a need for a method of selectively eliminating carrier gas ions and/or a portion or all matrix ions without eliminating or neutralizing the analyte ions.

Apparati that have been used to carry out these processes may be characterized as an ion source coupled or connected to a mass analyzer. Specifically known are an inductively coupled plasma ion source connected to a time-of-flight mass spectrometer (Myers et al., Journal of the American Society for Mass Spectrometry, Vol. 6, pp. 411–420 (1995)) or connected to an ion trap (D W Koppenaal, C J Barinaga, and M R Smith, J. Analytical Atomic Spectrometry Vol. 9, pp. 1053–1058 (1994); and C J Barinaga and D W Koppenaal, Rapid Communications in Mass Spectrometry, Vol. 8, pp. 71–76 (1994)), an electrospray ion source connected to a time-of-flight mass spectrometer (AN Verentchikov, W Ens, and KG Standing, Analytical Chemistry Vol. 66, pp. 126–133 (1994)) or to a collision cell containing a non-reactive gas with the collision cell connected to a linear quadropole mass spectrometer (D J Douglas and J B French, Journal of the American Society for Mass Spectrometry Vol. 3, pp. 398–403 (1992); also U.S. Pat. No. 4,963,736]) or an MS ion source through collision cell with non-reactive gas to time-of-flight mass spectrometer (A N Krutchinsky, I V Chernushevich, V Spicer, W Ens, and K G Standing, Proceedings of the 43$^{rd}$ ASMS Conference on Mass Spectrometry and Allied Topics, p. 126, May 21–26, 1995).

As is known in the art, a collision cell defines a region of space containing a sufficiently high pressure of a gas. The gas may be reactive or non-reactive gas. If necessary, the collision cell is provided with a guiding field (electric or magnetic to ensure that ions can traverse the cell in spite of a large number of collisions with the gas. A typical guiding field may be formed using an RF/DC multipole which restricts ion motion transverse to the long axis of the multipole while allowing relatively unrestricted motion along the axis. Multipoles may be formed in a wide variety of ways well known in the art. Typically, a multipole is formed by arranging an even number of pole elements, typically circular cross section rods, symmetrically around a common axis with the radial separation of the rods constant along the length of the multipole. The theory, design and performance of such multipoles has been described in great detail by Gerlich (Dieter Gerlich, in *State-Selected* and *State-to-State Ion-Molecule Reaction Dynamics, Part 1: Experiment; in Advances in Chemical Physics Series* Vol. LXXXII; Cheuk-Yiu Ng and Michael Baer, editors; John Wiley & Sons, 1992) and others.

SUMMARY OF THE INVENTION

Accordingly, it is an object of the invention in one of its aspects to provide an apparatus for producing an ion beam with increased proportion of analyte ions to carrier gas ions and/or matrix ions (if present) and a corresponding decreased proportion of carrier gas ions and/or matrix ions by neutralizing carrier gas ions and/or matrix ions while minimally removing or neutralizing the analyte ions. This is accomplished by an ion source providing the ion beam at a desired kinetic energy and directing the ion beam either into an ion trap or through a collision cell having a volume of a reagent gas (selectively reactive gas) wherein the carrier gas ions and/or matrix ions selectively reacts with the reagent gas rendering the carrier gas ions and/or matrix ions a neutral species, or the carrier gas ions and/or matrix ions are incorporated into product ions with different masses than the carrier gas ions and/or matrix ions. After this reaction, the resulting ion beam thus contains an increased proportion of analyte ions to carrier gas and/or matrix ions. and the product ions may be then selectively dispersed, leaving an ion beam having a greater fraction of analyte ions to total ions. The ion beam may be directed to a mass analyzer.

As used herein, the term "aperture" is used as understood in this art to be a solid element with a through hole, that can be a plate, cylinder or other geometric shape. The solid element (e.g. plate and/or cylinder) is the physical element defining the hole through which ions or gas pass.

As used herein, reaction refers to any pathway for reaction between reagent gas and carrier gas ions and/or matrix ions wherein the net effect is that carrier gas ions and/or matrix ions are rendered charge neutral or react so as to form product ions with mass-to-charge (m/z) ratio different from the carrier gas ions and/or matrix ions. Reactions may include but are not limited to charge transfer, atom transfer, and bond insertion.

As used herein, charge transfer refers to any pathway wherein the net effect is that charge is exchanged between a charged species and a neutral species. The pathway may involve steps which are not charge transfer reactions. Steps within the pathway may include but are not limited to chemical reaction(s), alone or in series, such as resonant charge transfer(s), electron transfer, proton transfer, and atom transfer.

As used herein, selectivity of a reaction refers to a ratio of the extent of reaction between the reagent gas and the carrier gas ions to the extent of reaction between the reagent gas and the non-carrier gas ions (e.g analyte ions and/or matrix ions). Preferably the ratio is at least 10, most preferably at least 1000.

As used herein, analyte ion refers to any ion generated by any means including but not limited to thermal ionization, ion beams, electron impact ionization, laser irradiation, electrospray, and variations thereof such as lonspray™, inductively coupled plasmas, microwave plasmas, glow discharges, arc/spark discharges and hollow cathode discharges. Analyte ions are distinguished from other ions (carrier gas ions, matrix ions, and background ions) in that analyte ions are desired to be detected or utilized in isolation from other ions. Thus, the occurrence of other ions is an interference or limitation in the detection or utilization of analyte ions. As used herein, reagent gas refers to any gas suitable for selective reaction with carrier gas ions and/or matrix ions. Reagent gas may be provided by any means including but not limited to commercially available substances provided in gaseous form and mixtures thereof and gases, vapors, particles, or aerosols generated by evaporation or laser ablation of condensed substances. Further, reagent gas as used herein may include neutral species of carrier ions, analyte ions, or matrix ions generated by any of the foregoing methods. Also, as will be apparent to those skilled in the art, the method of the present invention is not limited to systems containing a carrier gas per se. Typically, the gas species are an analyte, matrix, and a carrier gas. However, the method of the present invention will work equally well in any system having two or more ion species, even if none of the species were provided as a carrier gas or matrix. For example, in applications where daughter ions generated by the dissociation of any charged species are undesirable, suitable reagents may be selected to remove or neutralize those daughter ions by charge transfer. Similarly, a particular sample may contain a substance of interest in mixture with a separate interfering substance. Suitable reagents may be selected to remove or neutralize the separate interfering substance by selective reaction. For example, isobaric interferences in elemental mass spectrometry can be resolved by causing selective reaction of one or more of the interfering elements. In a preferred embodiment of the invention, the carrier gas selected is argon and the reagent gas selected is hydrogen.

As used herein, ion source can be an elemental ion source including but not limited to inductively coupled plasma ion source, thermal ionization, ion beams, electron impact ionization, laser irradiation, inductively coupled plasmas, microwave plasmas, glow discharges, arc/spark discharges and hollow cathode discharges, and combinations thereof. An ion source may be a molecular ion source, including but not limited to electrospray ion source.

RF multipoles may be formed in a wide variety of ways well known in the art. Typically, an RF multipole is formed by arranging an even number of pole elements, typically circular cross section rods, symmetrically around a common axis with the radial separation of the rods constant along the length of the multipole. The theory, design and performance of such RF multipoles has been described in great detail by Gerlich (Dieter Gerlich, in *State-Selected* and *State-to-State Ion-Molecule Reaction Dynamics, Part 1: Experiment*; in Advances in Chemical Physics Series Vol. LXXXII; Cheuk-Yiu Ng and Michael Baer, editors; John Wiley & Sons, 1992) and others. However, most of these design features may be modified without destroying the ion guiding properties of the multipole. For example, the pole elements need not be circular in cross section, the cross sectional shape need not be constant along the length of the pole elements, the radial separation of the pole elements need not be constant, while an even number of pole elements should be used, the pole elements may have different cross sectional shapes, the multipole may be "bent" by forming a bend in each pole element at some point along its length, the length of the pole elements may be comparable to the radial separation of the pole elements, although the length is typically many times greater than the radial separation of the pole elements. Thus, as used herein, a linear RF multipole refers to any RF multipole that is formed using pole elements of uniform cross section along their length, arranged approximately symmetrically around a single, common axis. The separation of the rods in a linear RF multipole may be constant along the length of the multipole or not constant. As used herein, non-linear RF multipole refers to RF multipoles formed in any other manner including but not limited to the use of non-circular cross section pole elements, the use of different cross sectional sizes or shapes for the pole elements within a single multipole, the use of bent pole elements to form a bent multipole. Non-linear is also known in the art as a description of the symmetry of an electric field wherein the restoring force experienced by an ion displaced from the center of the field (or from the minimum in the potential energy surface which defines the field) varies non-linearly with the spatial displacement of the ion. In the context of RF multipoles, only a perfectly quadrupolar field is linear in this sense; all other multipole fields, including actual quadrupole fields, have some degree of non-linearity. As used herein and as is well known in the art, any actual RF multipole will have a field whose symmetry is composed of linear components (i.e., quadrupolar) and non-linear components (i.e., hexapolar, octopolar, and higher order symmetries).

Accordingly, it is an object of the invention in one of its aspects to provide an apparatus for selectively reducing the charge density of an ion beam by neutralizing the ions of a carrier gas (preferably argon), without eliminating or neutralizing the analyte ions. This is accomplished by directing the ion beam from an ion source either into an ion trap or through a collision cell having a volume of selectively reactive gas (preferably hydrogen) at kinetic energies wherein the carrier gas selectively transfers charge to the selectively reactive gas. In this apparatus, it is theorized that the bulk of the ion beam is selectively shifted from m/z of 40 ($Ar^+$) to m/z 3 ($H_3^+$) and m/z 2 ($H_2^+$). It is therefore a further object of the invention in one of its aspects to provide an apparatus for-selective transfer of charge from $Ar^+$ to $H_2$. Due to hydrogen's low molecular weight, in many applications it is possible to rapidly and selectively eject $H_3^+$ and $H_2^+$ from an ion beam without ejecting analyte ions where it would have been difficult or impossible to selectively eject $Ar^+$ ions from the ion beam without also ejecting or removing analyte ions. Thus, it is a further object of the invention in one of its aspects to provide an apparatus for rapidly ejecting $H_3^+$ and $H_2^+$ from an ion beam, yet minimally reducing or ejecting analyte ions.

Thus, it is a further object of the invention in one of its aspects to an apparatus for providing a beam selectively depleted in $Ar^+$, and therefore having a much lower total ion density, yet minimally reduced ion density of analyte.

The great abundance of $Ar^+$ in an Ar ICP leads to formation of molecular ions by charge transfer and other reactions of $Ar^+$. For example, $ArC^+$, $ArN^+$, $ArO^+$, $Ar_2^+$ have all been observed in conventional ICP mass spectra and are thought to form early in the plasma sampling process or in the ICP itself. Other molecular ions may be formed by reaction of certain vacuum system background gases ($H_2O$, $O_2$, $N_2$, CO, organics from pump oil, etc.) with $Ar^+$ or other plasma ions. These molecular ions are nuisances in that they overlap isobarically with elemental ions of interest, e.g., $^{28}Si^+$ and $N_2^+$, $^{55}Mn^+$ and $C_4H_7^+$ $^{56}Fe^+$ and $ArO^+$, $^{80}Se^+$ and $Ar_2^+$. These molecular ions may react with $H_2$ or other reagent gases in such a way as to be neutralized. For example, $Ar_2^+$ reacts with $H_2$ to form $ArH^+$ which reacts further with $H_2$ eventually forming $H_2^+$ and/or $H_3^+$. Similarly, $Ar_2^+$ reacts with $H_2$ to form $Ar_2H^+$ which reacts further with $H_2$ to form $H_3^+$. By way of further example, $C_4H_7^+$ may be reduced concomittantly with the reduction in $Ar^+$ afforded by the present invention since one mechanism for the formation of hydrocarbon ions is chemical ionization by $Ar^+$. For these reasons, it is expected that many of these molecular ion interferences will be reduced if $Ar^+$ neutralized early in the ICP sampling process.

Thus, it is a further object of the invention in one of its aspects to provide an apparatus for providing a beam selectively depleted in $Ar^+$ and therefore having a much lower background signal at a wide range of m/z values corresponding to the aforementioned molecular ion interferences.

Methods for removing unwanted ions from ion traps are highly beneficial. The charged reagent gas may be removed by resonance ejection, the sudden (i.e., quick with respect to the period of the trapping RF waveform) change in m/z due to the ion-molecule reaction, loss due to instability by virtue of a m/z lower than the lowest m/z ion stably stored in the trap (i.e., the charged reagent gas m/z is lower than the so-called "low mass cut-off" of the ion trap). According to the present invention, a method for removing ions selectively is by ion-molecule reaction where an ion which is desired to be removed from the ion trap reacts with a reagent gas thereby forming a charged reagent gas, wherein the charged reagent gas is more easily removed from the ion trap than the former ion.

Thus, it is a further object of the invention to provide an ion trap the interior of which is pressurized with reagent gas and in which the trapped ions are selectively depleted in carrier gas ions by virtue of reaction between the reagent gas and the carrier gas ions.

It is a further object of the invention to provide such an ion trap wherein the reagent gas is hydrogen and the carrier gas is argon.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

Figure 3:
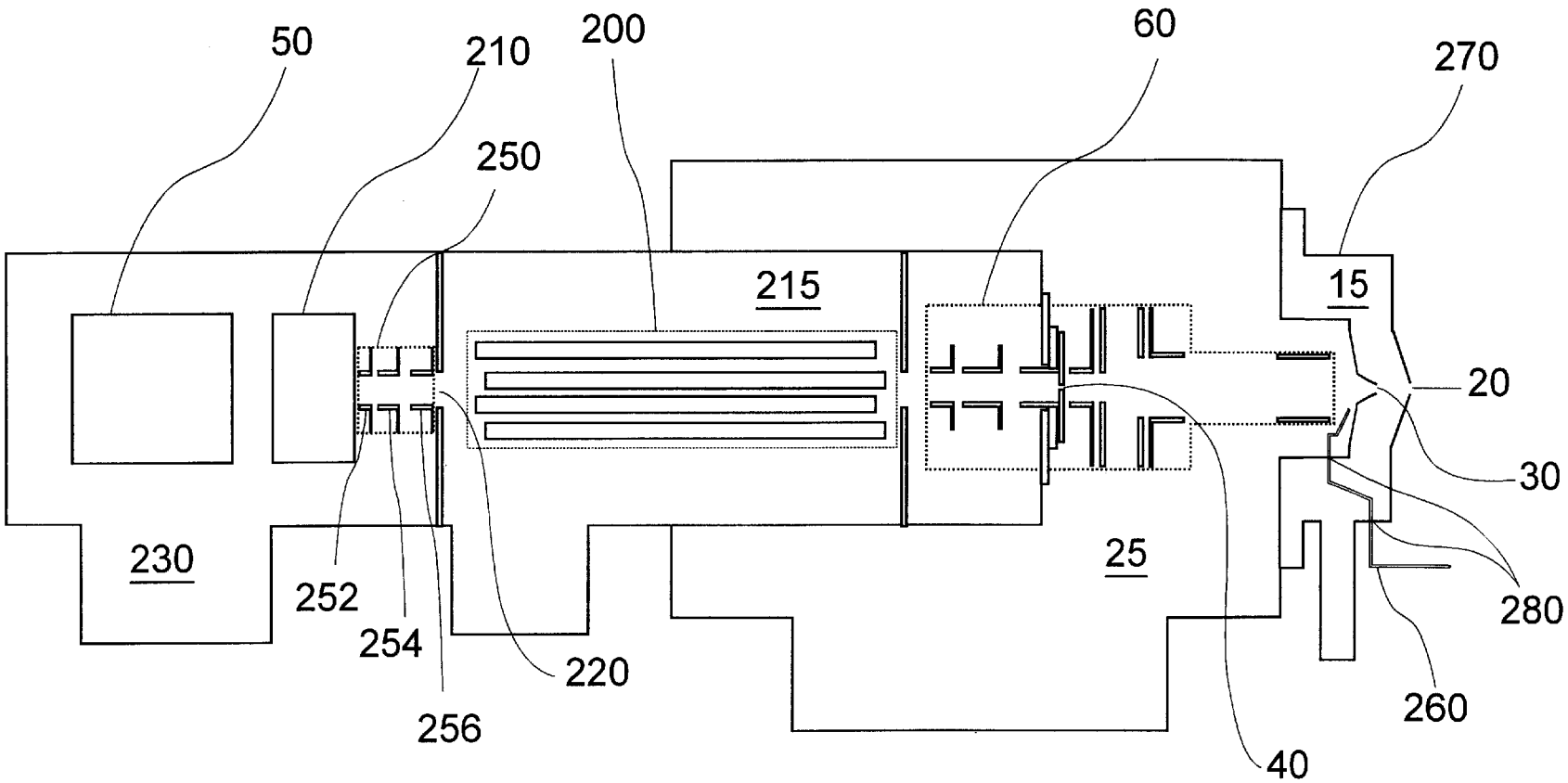
FIG. 3 is a schematic drawing of the apparatus used in the second preferred embodiment of the present invention.

The apparatus (FIG. 1) for reacting selected ions in an ion beam having more than one species of ions with a reagent gas and thereafter preferentially dispersing the product ions was demonstrated in inductively coupled plasma mass spectrometers (hereafter called ICP/MS). An ICP/MS is a device wherein a plasma consisting of a carrier gas (typically argon) and a sample is generated in an inductively coupled plasma (ICP) and a mass spectrometer is employed to separate and distinguish constituent atoms and isotopes. For both convenience of operation and to maintain a desirable temperature in the plasma, the ICP is typically operated at atmospheric pressure. In order to transfer ions from the plasma to a mass spectrometer, the plasma is directed through two apertures 20, 30 and then through a lens stack 60. The plasma is thereby converted into an ion beam containing analyte ions and carrier gas ions and/or matrix ions. A lens stack 60 typically consists of a series of lens elements 70, 80, typically plates and/or cylindrical tubes which have potentials applied to them and which have apertures through which the ion beam is directed. The ion beam is directed through these lens elements 70, 80 which focus the ion beam into a narrow stream which is directed to a mass analyzer 10, or a linear quadrupole 200 (FIG. 3). As used herein, mass analyzer or ion discriminating unit refers to any apparatus which separates charged species according to their m/z and/or kinetic energy. Ion discriminating units include but are not limited to a linear quadrupole, a quadrupole ion trap, a time-of-flight tube, a combination of a quadrupole ion trap and a time-of-flight tube, a magnetic sector, an electric sector, a combination of a magnetic sector and an electric sector, a lens stack, a DC voltage plate, an ion cyclotron resonance cell, and an rf multipole ion guide. Modified ICP/MS systems have been built which use a three-dimensional RF quadrupole ion trap, either alone or in combination with a linear RF quadrupole as an ion discriminating unit. Upon exiting the lens stack, the ion beam is directed into the ion discriminating unit. Ions are selectively emitted from the ion discriminating unit according to their mass to charge ratio (m/z) and/or kinetic energy. These selectively emitted ions are then directed to a charged particle detector 50. In this manner, the ICP/MS is able to determine the presence of selected ions in an analyte according to their (m/z) and/or kinetic energy. It is critical to maintain the ion discriminating unit in a vacuum because collisions or reactions between the ions and any gases present in the ion discriminating unit will tend to deflect ions away from the charged particle detector or neutralize the ions of analyte. It is critical to maintain the charged particle detector in a vacuum because the high potential across the detector will cause an electrical discharge in any gas present in sufficient pressure, typically above $10^{-4}$ Torr. One or more pumps are thus typically utilized to evacuate a series of chambers in between the ICP and the charged particle detector. The chambers are separated by one or more apertures to achieve the transition from atmospheric pressure at the ICP to high vacuum at the charged particle detector (typically between about $10^{-7}$ and $10^{-4}$ torr). To effect the large differential in pressure, ICP/MS systems typically employ apertures between approximately 0.5 mm to approximately 2 mm.

Figure 1:
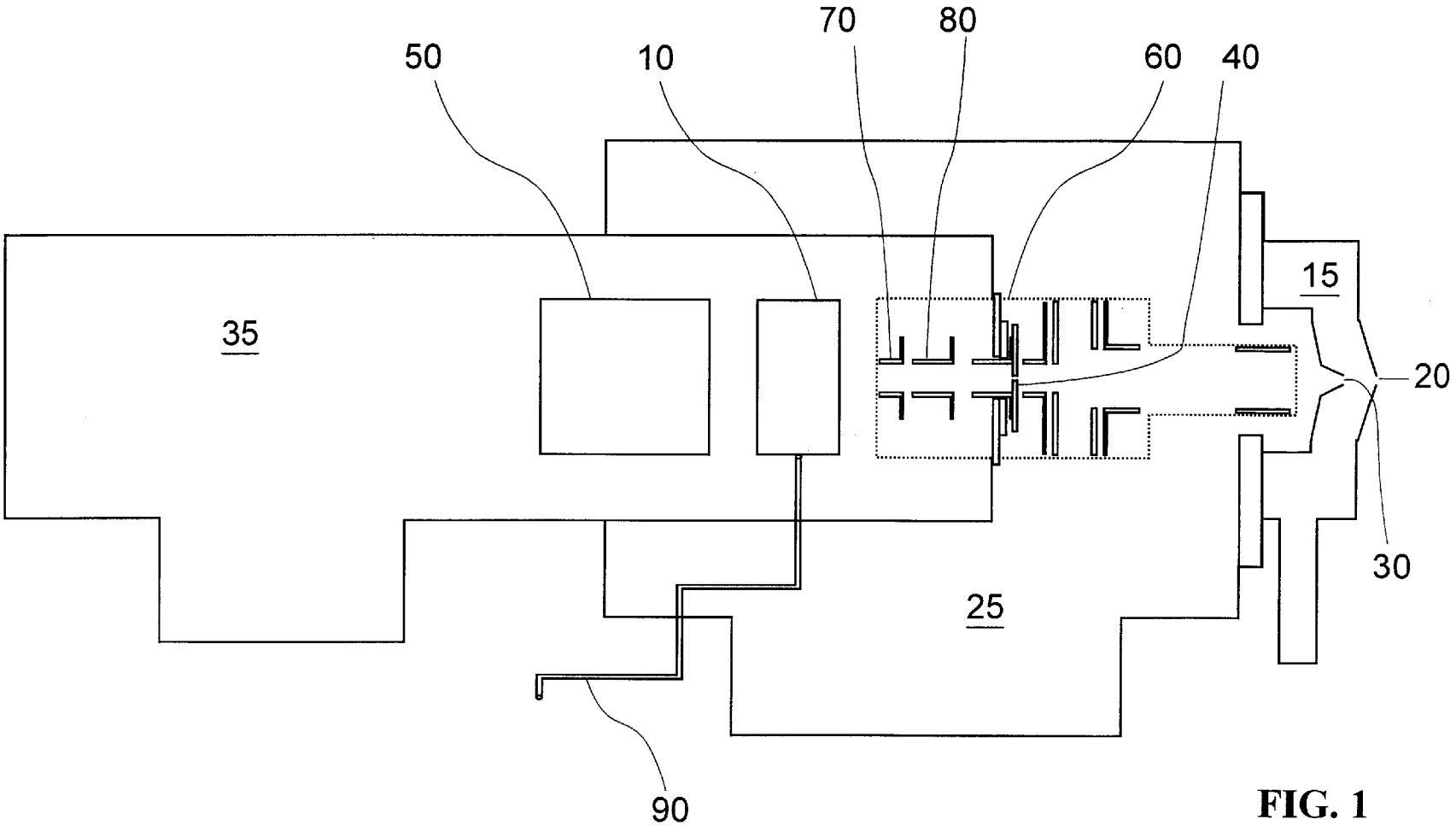
FIG. 1 is a schematic drawing of the apparatus used in the first preferred embodiment of the present invention.
Figure 7:
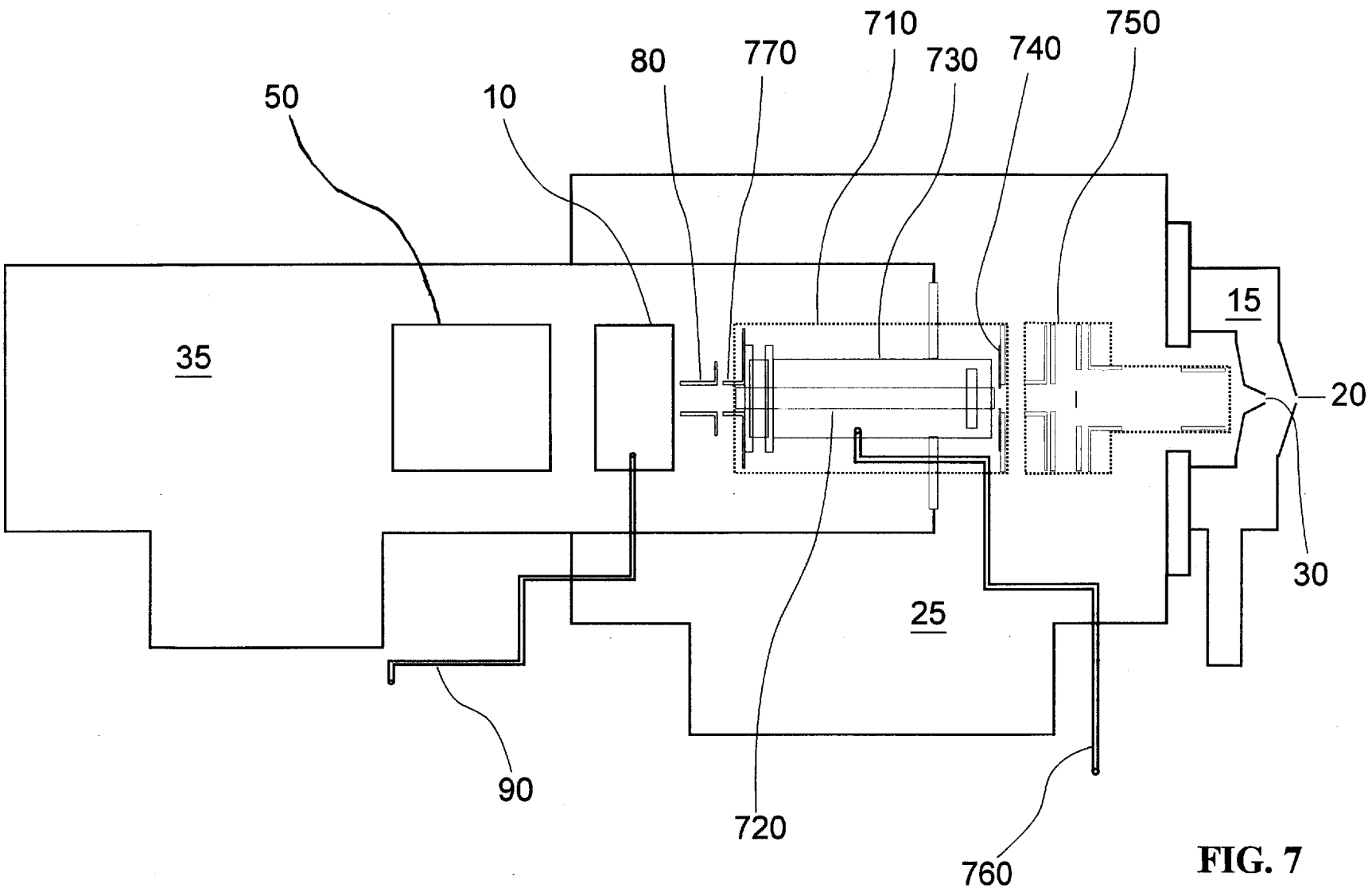
FIG. 7 is a schematic drawing of the apparatus used in the fourth preferred embodiment of the present invention.

According to the present invention, at least one collision cell containing the reagent gas is placed between the first aperture 20 and the charged particle detector 50. FIG. 7 depicts a deployment of a collision cell 710. A collision cell may be between the first and second apertures 20, 30, between the second aperture 30 and the lens stack 60, between lens elements in the lens stack 60, or between the lens stack 60 and the mass analyzer 10 (e.g. quadrupole ion trap). Alternatively, an ion trap containing the reagent gas may be placed between the first aperture 20 and the charged particle detector 50. FIG. 1 depicts a deployment of a mass analyzer 10 that is a quadrupole ion trap. An ion trap may be between the apertures 20, 40, between the apertures 30, 40, between the differential aperture 40 and the charged particle detector 50. Yet other arrangements are possible, for example with an ion trap located between first aperture 20 and the charged particle detector 50, various lens stacks may be utilized between the aperture 20 and the ion trap and between the ion trap and the charged particle detector. Other mass analyzers may also be employed in combination with the ion trap and located between the first aperture 20 and the ion trap and/or between the ion trap and the charged particle detector 50.

In operation, the reagent gas is introduced within an ion beam having a carrier gas and a sample to allow the carrier gas ions and/or matrix ions to react or to be neutralized, whereupon the product ions may be selectively dispersed from the ion beam. The extent of reaction will be driven by at least four factors. First, any two species selected will have an inherent rate of reaction which will affect the completeness of reaction over a given period of time, all other things held constant. Second, lower ion velocities will provide a longer residence time for ions in the reaction zone and thereby provide a greater extent of reaction. Third, there is a velocity dependence for the reaction cross section which is in general different for any given reacting species so that for any given reaction the optimum velocity may be low or high. Fourth, the completeness of reaction in a given time period is increased as the probability of a collision between the ions and reagent gas species is increased. Therefore, the completeness of reaction is dependent upon the pressure of the reagent gas and the time that the two gases are in contact Ions must have sufficient opportunities to come into contact with the reagent gas, i.e., a long residence time must be employed if the reagent gas species is present at low concentration or pressure.

As will be apparent to those skilled in the art, although the present invention has been described as employed in an ICP/MS, the apparatus of the present invention may be advantageously applied in any system having a collision cell and/or an ion trap filled with a reagent gas into which a carrier gas and an analyte gas are introduced wherein the carrier gas ions are removed or neutralized. The ICP/MS system, as well as the instruments described in the preferred embodiments which follow, both practice and are demonstrative of the present invention because they contain detection elements to verify the selective neutralization or removal of carrier gas ions.

THE FIRST PREFERRED EMBODIMENT

In a first preferred embodiment shown in FIG. 1, a conventional ICP/MS manufactured by VG Elemental, now Fisons (Winsford, Cheshire, England; model PQ-I) was modified by replacing the linear quadrupole and its associated electronics (not shown) with the mass analyzer 10 as a quadrupole ion trap and its associated electronics (not shown). The quadrupole ion trap was installed with the ion input and output ends reversed to maximize the ion transfer efficiency from the lens stack 60 into the quadrupole ion trap. The quadrupole ion trap used was removed from a quadrupole ion trap mass spectrometer (ITMS™) manufactured by Finnigan MAT (San Jose, Calif.). The electron gun (not shown) and injection gate electrode assembly (not shown) were removed to allow transfer of ions from the lens stack 60 into the quadrupole ion trap. The vacuum system was modified from a standard Fisons vacuum system and consisted of three vacuum regions separated by two apertures. These vacuum regions are evacuated by standard vacuum pumps (not shown). The first vacuum region 15 is contained in between a first aperture 20 and second aperture 30 and is typically operated at 0.1 to 10 Torr. The second vacuum region 25 is contained between the second aperture 30 and a differential aperture 40 and is typically operated at $10^{-5}$ to $10^{-3}$ Torr. The differential aperture 40 is located within the lens stack 60 at substantially the same 5 position as employed in the standard Fisons ICP/MS. The third vacuum region 35 is separated from the second vacuum region 25 by the differential aperture 40. The third vacuum region 35 contains a portion of the lens stack 60, the quadrupole ion trap and a charged particle detector 50. The third vacuum region 35 is typically operated at $10^{31\ 8}$ to $10^{31\ 3}$ Torr. Other arrangements of vacuum pumps and apertures are possible in making the transition from atmospheric pressure at the ion source to high (or ultrahigh) vacuum at the charged particle detector.

Experiment 1

A series of experiments was performed utilizing the apparatus described in the first preferred embodiment. The configuration of the various components is shown in FIG. 1. The vacuum regions 15,25,35 were operated under conventional conditions as described above. The potentials applied to the lens stack 60 were within the ranges recommended by the manufacturer of the ICP/MS (Fisons). The first and second apertures 20,30 were both grounded. The differential aperture 40 was biased at a DC potential of about −120 V. The potentials on the lens elements 70,80 were optimized for maximum transfer efficiency of ions into the quadrupole ion trap and were different than the potentials used in conventional ICP/MS instruments. Ions are gated into the quadrupole ion trap by switching the potential on lens element 80 in the lens stack 60. The potentials on lens element 80, described as lens element "L3" by the manufacturer (Fisons), were switched between a negative value used to admit ions into the quadrupole ion trap, in the range between about −10 V to about −500 V, preferably −35 V, and a positive value used to prevent ions from entering the quadrupole ion trap, in the range between about +10 V to about +500 V, preferably above +10 V, or the kinetic energy of the ions. The electronic gating control (not shown) used for switching the voltage on lens element 80 was provided by inverting the standard signal provided by the Finnigan MAT ITMS to gate electrons. This inversion was accomplished using an extra inverter (not shown) on the printed circuit board (not shown) that performs the gating.

The quadrupole ion trap is manufactured with a port 90 typically used for introduction of a buffer gas such as helium. Reagent gases were introduced into the quadrupole ion trap by adding the reagent gases to the helium. Typical helium buffer gas pressures were in the range between about $10^{-5}$ and $10^{31\ 3}$ Torr. Reagent to buffer gas pressure ratios ranged between about 0.01% to 100%. Experiments were performed in this instrument wherein Ar, $H_2$, Xe, or Kr were introduced as reagent gases into the quadrupole ion trap.

Figure 2:
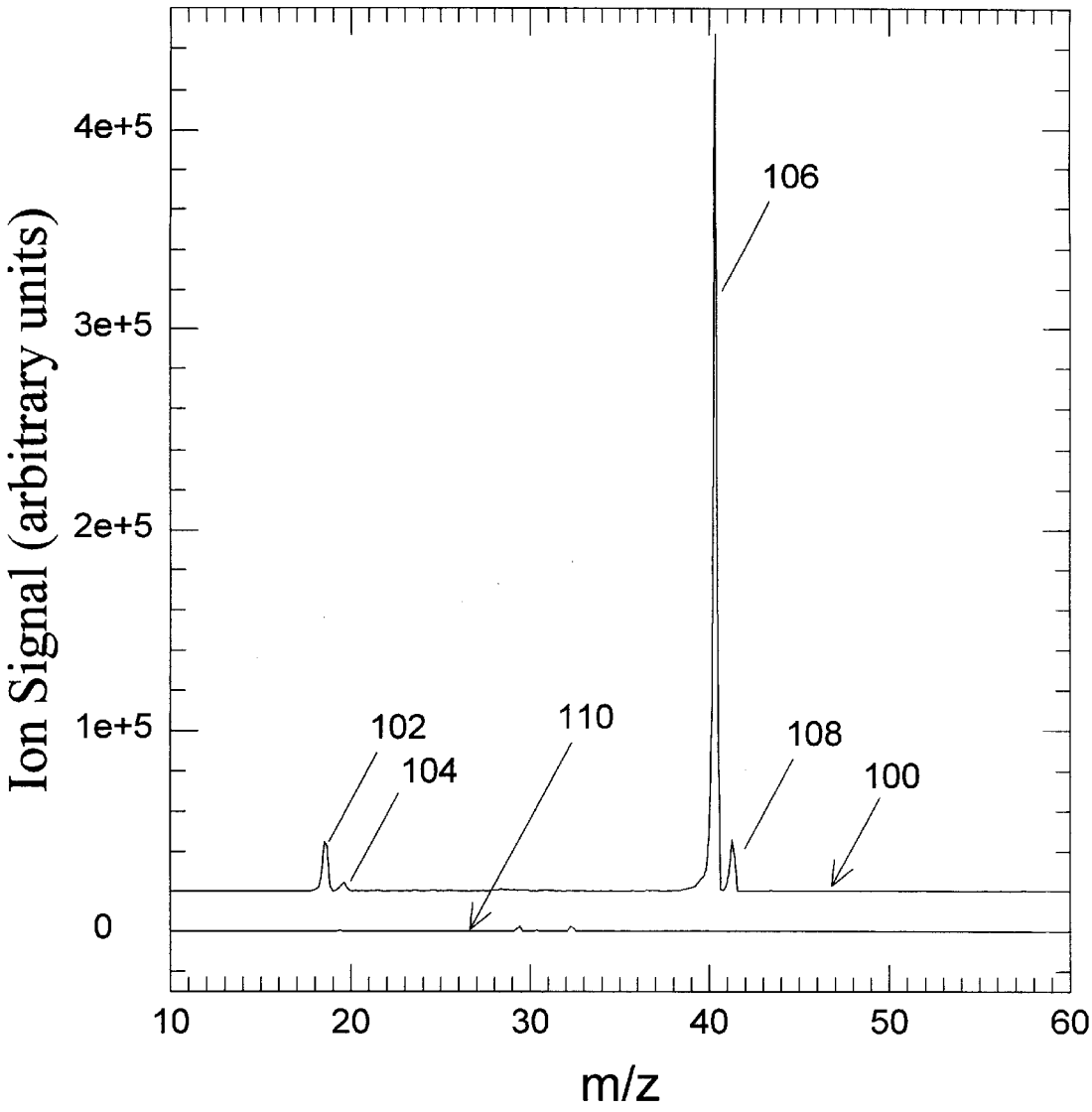
FIG. 2 is two mass spectra from experiments performed in the apparatus used in the first preferred embodiment of the present invention.
Figure 2A:
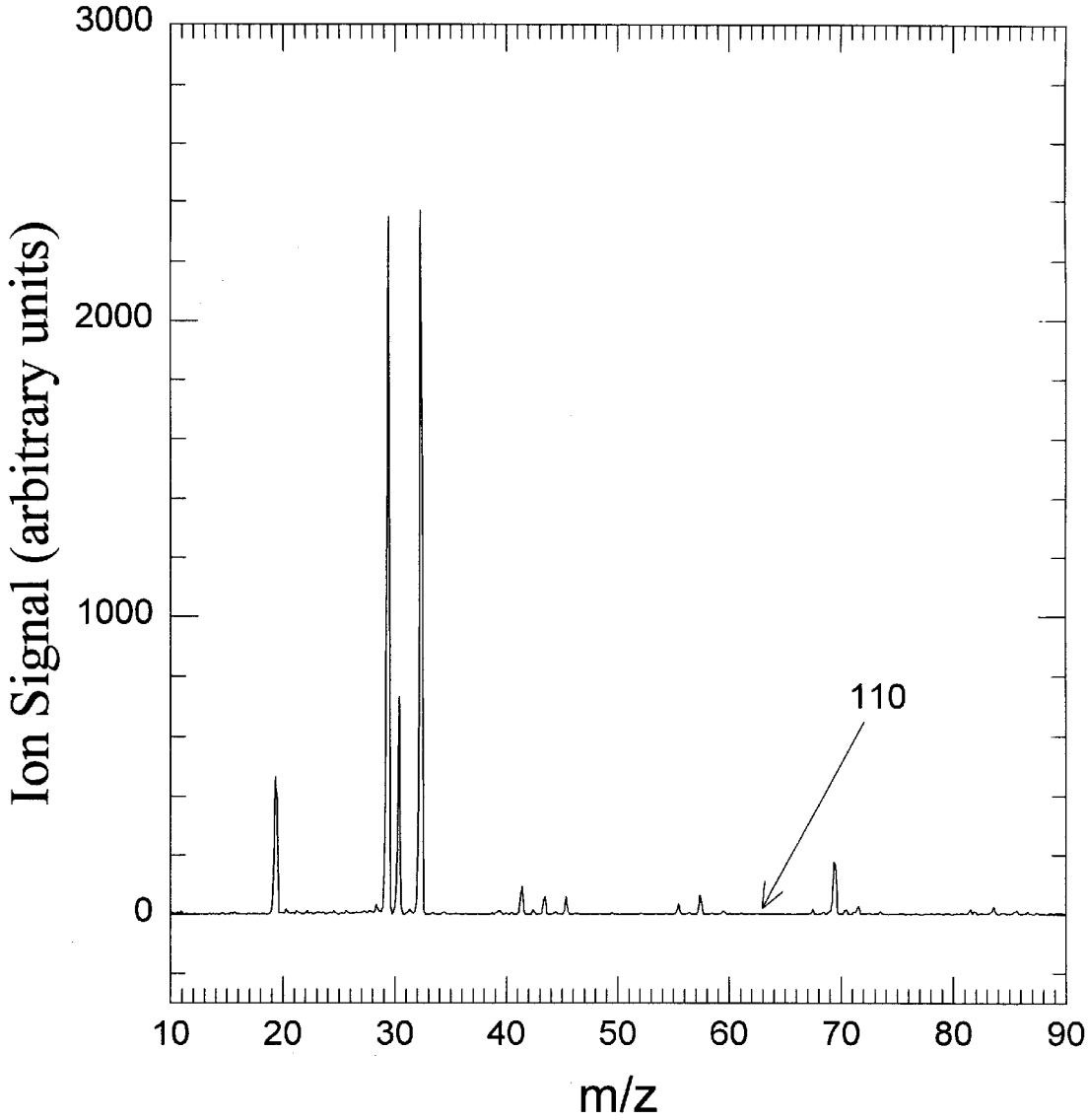
FIG. 2*a* is the lower trace 110 of FIG. 2 at a finer vertical scale.

The effect of these reagent gases on the analyte and ion signals was observed by recording the quadrupole ion trap mass spectrum. Representative mass spectra showing the effects of added $H_2$ are shown in FIG. 2. The upper trace 100 in FIG. 2 was obtained using pure helium buffer gas and is offset from zero for the sake of clarity in FIG. 2. The lower trace 110 in FIG. 2 was obtained using about 5% $H_2$ and about 95% helium. The upper trace 100 shows the intensity of various peaks, most notably, $H_2O$+ at m/z 18 102, $H_3O^+$ at m/z 19 104, $Ar^+$ at m/z 40 106, $ArH^+$ at m/z 41 108. With the addition of $H_2$ as a reagent gas, $Ar^+$, $H_2O^+$, $ArH^+$, and $H_3O^+$ are dramatically reduced as indicated by the reduction of peak intensities at the appropriate m/z in the lower trace 110, indicating the near or total elimination of these charged species. FIG. 2*a* shows the lower trace 110 of FIG. 2 at a finer vertical scale, i.e., "blown up". In addition to the absence of $Ar^+$, $ArH^+$, and $H_2O^+$, several other ions commonly observed in ICP/MS spectra are notably absent in the lower trace 110 shown in FIG. 2*a*. These other ions include $ArO^+$ and $Ar_2^+$, among others.

In addition to the elimination of these charged species, one must also be concerned with the effect of any added reagent gases on the analyte ions. Atomic cations of the following elements have been tested for reaction with $H_2$ in the apparati of the preferred embodiments described herein using argon as carrier gas: N, O, Na, Mg, Al, Si, K, Ar, Ca, Sc, Ti, V, Cr, Mn, Fe, Co, Ni, Cu, Zn, Ga, As, Se, Kr, Rb, Sr, Y, Zr, Mo, Rh, Ag, Cd, In, Sb, I, Xe, Cs, Ba, TI, Pb, Bi, Th, and U. In all of the experiments, the only ions found to react were $N^+$, $O^+$, $Si^+$, $Cl^+$, $Ar^+$, and $Kr^{30}$ . The reduction in $Ar^+$ intensity was at least 100,000 times greater than the reduction in any of the intensities of the other non-reactive ions listed.

THE SECOND PREFERRED EMBODIMENT

In a second preferred embodiment as shown in FIG. 3, a conventional ICP/MS manufactured by VG Elemental, now Fisons (Winsford, Cheshire, England; model PQ-I) was modified by interposing a scaled mass analyzer 210, e.g. a scaled quadrupole ion trap between the linear quadrupole 200 and the charged particle detector 50. The electrodes (not shown) used in the scaled quadrupole ion trap were custom built to be scaled versions of the ITMS™ electrodes manufactured by Finnigan MAT (San Jose, Calif.), to increase the ion storage capacity of the ion trap and to reduce the mass range of the standard instrument (10-650 AMU) by about a factor of 2. This scaled ion trap size is independent of the use of a reagent gas according to the present invention. The electrodes of the custom built quadrupole ion trap were 44% larger than the electrodes of the Finnigan MAT ITMS and were assembled in a pure quadrupole, or un-stretched geometry. The standard ITMS™ electronics package (not shown) manufactured by Finnigan MAT was used with the modifications as described in the first preferred embodiment using the voltages as described below.

The lens stack 60 is operated at potentials recommended by the manufacturer. In addition to the lens stack 60, a second lens stack 250 is interposed between the quadrupole exit aperture 220 and the scaled quadrupole ion trap (scaled mass analyzer 210) in the fourth vacuum region 230. The second lens stack 250 consisted of three lens elements 252,254,256 taken from standard Fisons lens stacks, specifically two "L3" lens elements and an "L4" lens element. The second lens stack 250 was fabricated to provide high ion transport efficiency between the linear quadrupole 200 and the scaled quadrupole ion trap. A potential of between about −10 V and about −300 V, preferably about −30 V were applied to lens elements 252,256 at each end of the second lens stack 250. The center lens element 254 was used to gate ions into the scaled quadrupole ion trap and the potential applied was varied between about −180 V for the open potential and about +180 volts for the closed potential. The electronic gating control (not shown) used for the center lens element 254 of the second lens stack 250 was provided by inverting the standard signal provided by the Finnigan MAT ITMS™ to gate electrons into the quadrupole ion trap. This inversion was accomplished using an extra inverter (not shown) on the printed circuit board (not shown) that performs the gating.

The vacuum system was the standard Fisons system consisting of four vacuum regions separated by three apertures with an additional pump on the fourth vacuum region 230. These vacuum regions are evacuated by standard vacuum pumps (not shown). The first vacuum region 15 is contained in between the first aperture 20 and second aperture 30 and is typically operated at 0.1 to 10 Torr. The second vacuum region 25 is contained between the second aperture 30 and a differential aperture 40 and is typically operated at $10^{-5}$ to $10^{-3}$ Torr. The differential aperture 40 is located within the lens stack 60. The third vacuum region 215 is contained between the differential aperture 40 and the quadrupole exit aperture 220 and is typically operated at $10^{-8}$ to $10^{-4}$ Torr. The third vacuum region 215 contains the linear quadrupole 200. The fourth vacuum region 230 is separated from the third vacuum region 215 by the quadrupole exit aperture 220. The fourth vacuum region 230 contains the scaled quadrupole ion trap and a charged particle detector 50. The fourth vacuum region 230 is typically operated at $10^{-8}$ to $10^{-3}$ Torr.

As illustrated in FIG. 3, a tube 260 was provided to allow the introduction of reagent gases into the second vacuum region 25 through two ports 280 provided in the housing 270 surrounding the first vacuum region 15. The tube 260 was fashioned into a shape so as to avoid electrical contact with the lens stack 60 and to position the end of the tube 260 approximately 1 cm behind the base of the second aperture 30 and approximately 1 cm from the central axis defined by the four apertures 20,30,40,220. In this way, reagent gases are introduced into the second vacuum region 25 as close to the second aperture 30 as possible without interfering with the gas dynamics of the sampled plasma and with minimal distortion of the electric field generated by the lens stack 60.

Experiment 2

A series of experiments was performed utilizing various reagent gases and an argon carrier gas in the above-described apparatus shown in FIG. 3. Reagent gases, $H_2$, Ar, Xe, Kr and an Ar/Xe/Kr mixture, were introduced via tube 260 into the second vacuum region 25. Mass spectra were obtained for reagent gas partial pressures in vacuum region 25 between zero and about 1 mTorr to about 10 mTorr. Table I lists relative rates of reaction for the carrier gas and analyte ions shown in the first column with increasing pressure of the reagent gases listed at the top of the remaining columns. Thus, by way of example, the values in the second column under the heading "$H_2$" show that as the $H_2$ pressure is increased, the $Ar^+$ ion intensity falls about 10 times faster than the $In^+$ ion intensity, confirming the selective removal of carrier gas ions.

TABLE I

Relative Reaction Rates of Carrier Gas Ions and Analyte Ions with Reagent Gases

| Ions | $H_2$ | Ar | Ar/Xe/Kr |
|---|---|---|---|
| $Ar^+$ | 0.1 | 0.6 | — |
| $ArH^+$ | non-linear | 0.35 | 0.25 |
| $Sc^+$ | 0.017 | 0.23 | 0.18 |
| $^{84}Kr^+$ | 0.06 | — | 0.26 |
| $^{115}In^+$ | 0.01 | 0.24 | 0.14 |
| $^{129}Xe^+$ | 0.01 | — | 0.15 |

THE THIRD PREFERRED EMBODIMENT

Figure 4:
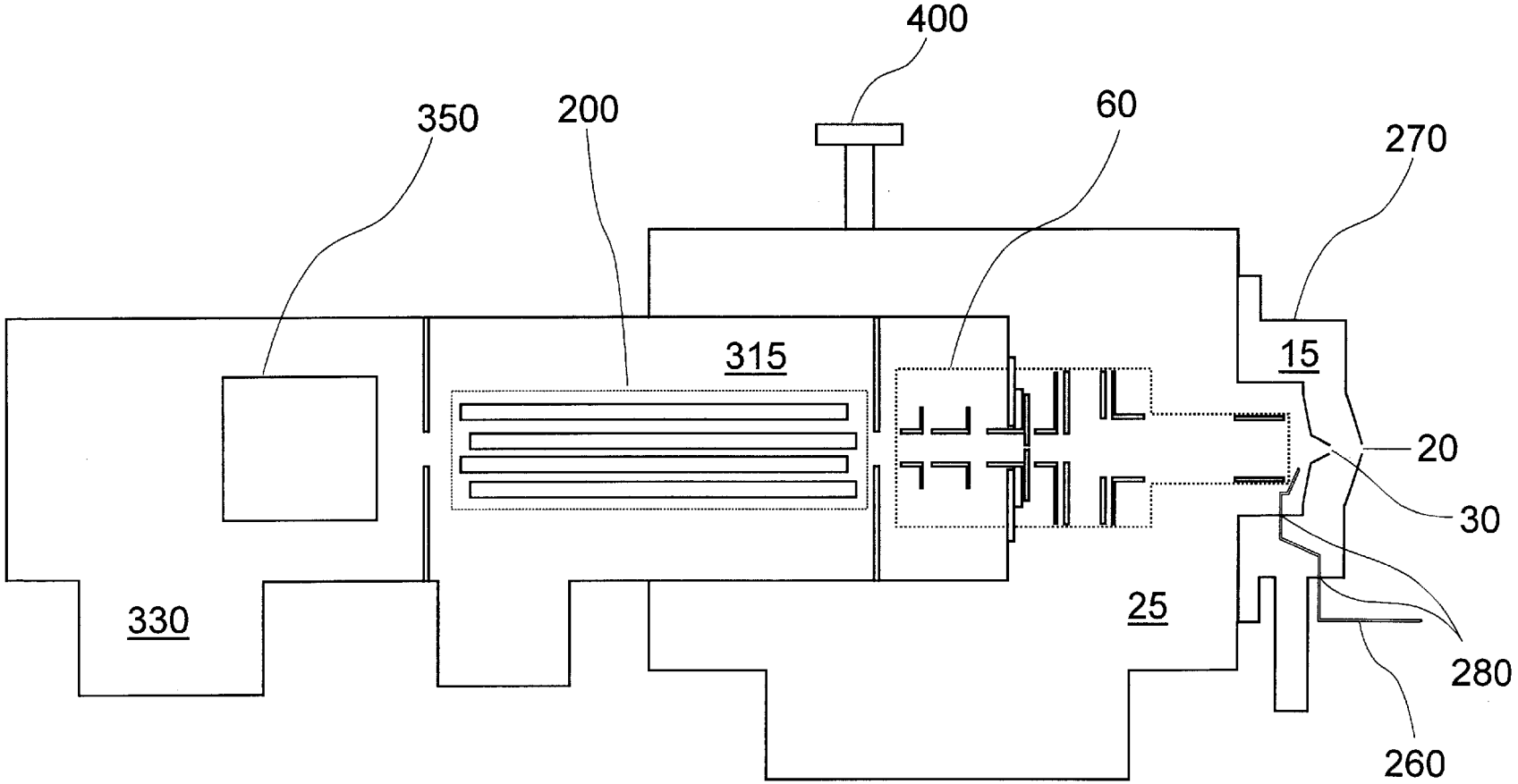
FIG. 4 is a schematic drawing of the apparatus used in the third preferred embodiment of the present invention.

In a third preferred embodiment shown in FIG. 4, a conventional ICP/MS manufactured by VG Elemental, now Fisons (Winsford, Cheshire, England; model PQ-II+) was modified by providing a tube 260 to allow the introduction of reagents into the second vacuum region 25 in a manner identical to the second preferred embodiment. As shown in FIG. 4, the remainder of the ICP/MS was not modified from that provided by the manufacturer. A series of experiments was performed utilizing an argon carrier gas and $H_2$ as a reagent gas introduced via tube 260 into the second vacuum region 25. Mass spectra were obtained for $H_2$ pressure in the second vacuum region 25 between zero and about 2 mtorr and are summarized below.

Experiment 3

Figure 5:
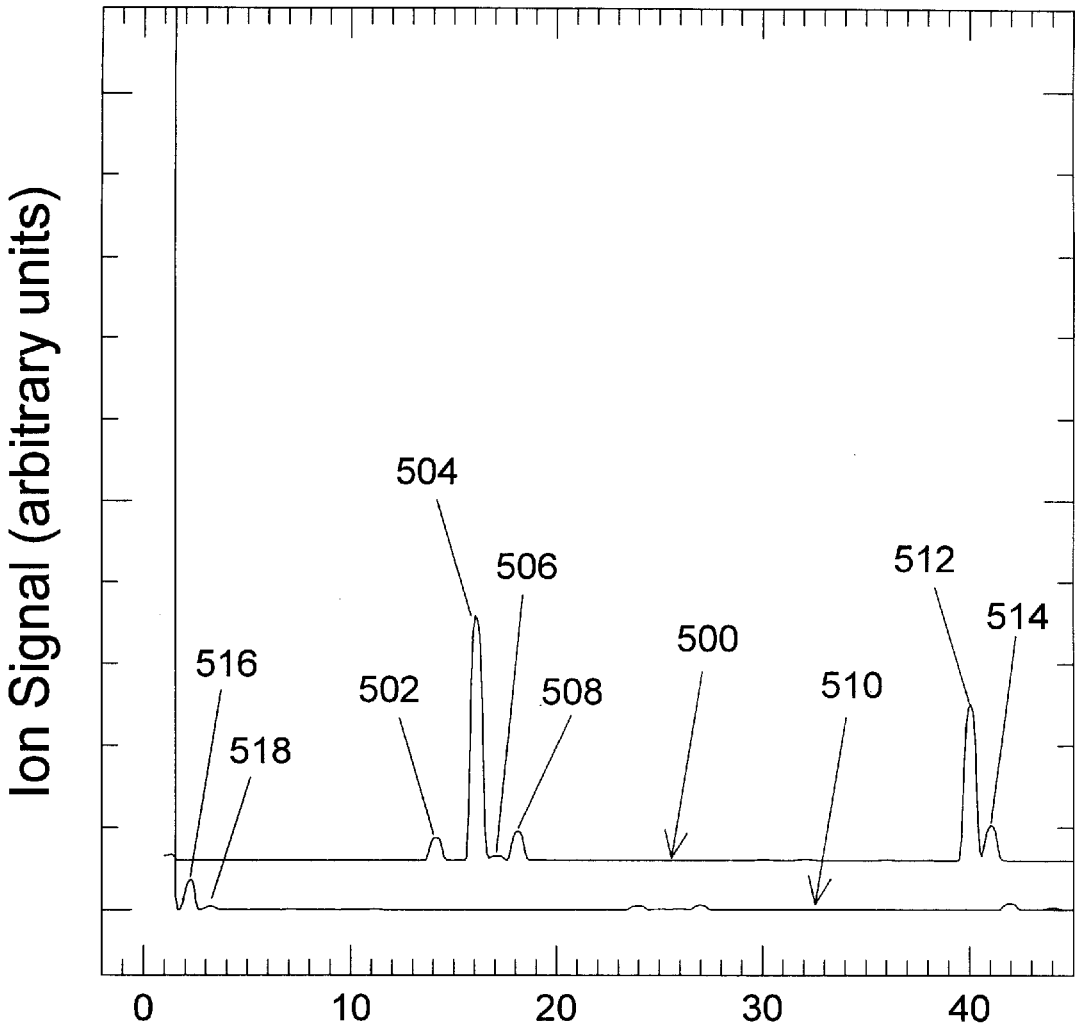
FIG. 5 contains two mass spectra from experiments performed in the apparatus used in the third preferred embodiment of the present invention.
Figure 6:
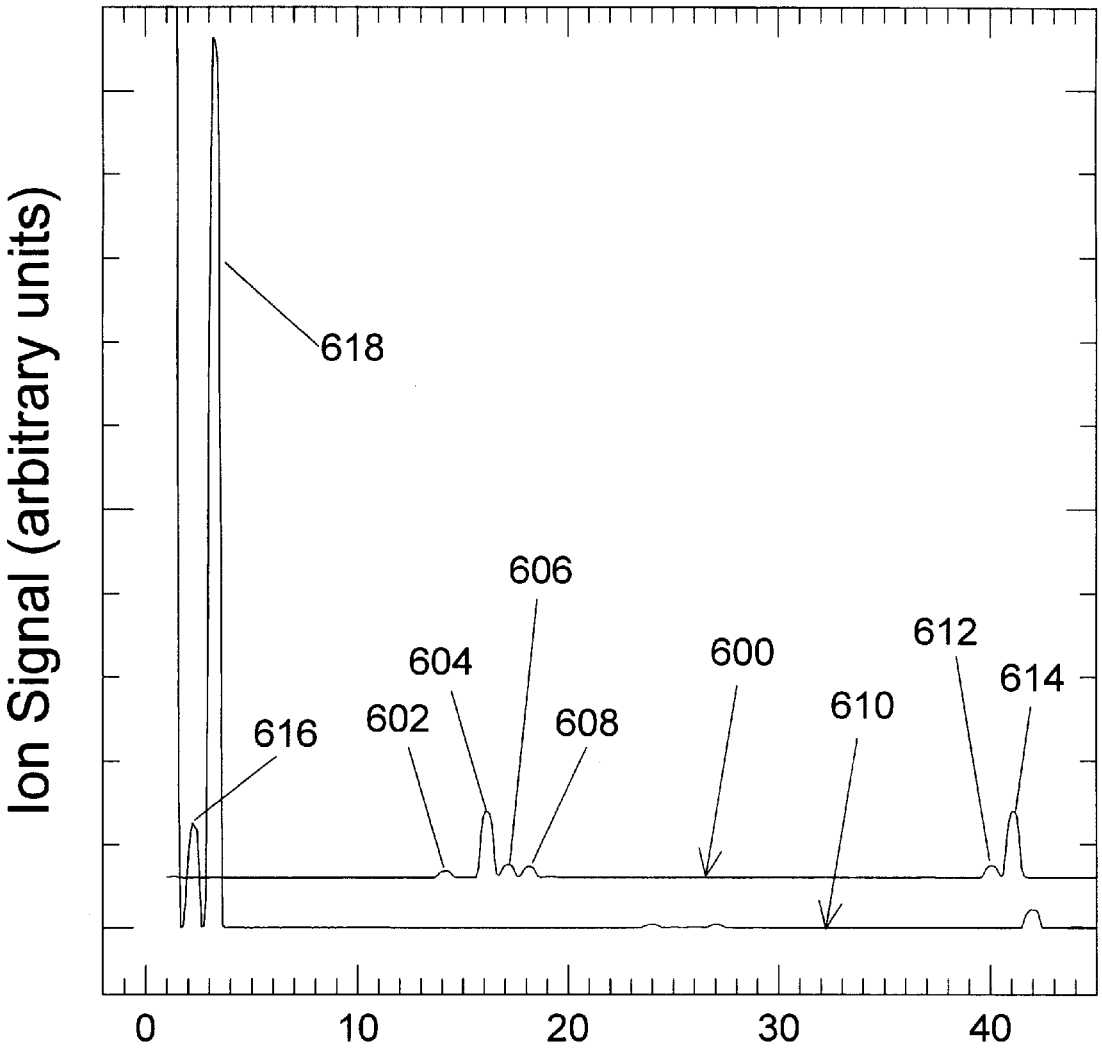
FIG. 6 contains two mass spectra from experiments performed in the apparatus used in the third preferred embodiment of the present invention.

The effect of $H_2$ pressure on the analyte and other ion signals were observed by recording the mass spectrum in both the analog and pulse counting modes of operation of the ICP/MS as provided by the manufacturer. Two mass spectra recorded without addition of $H_2$ into the second vacuum region 25 are shown in FIG. 5. The upper trace 500 in FIG. 5 was obtained using the analog mode of operation. The lower trace 510 in FIG. 5 was obtained using the pulse counting mode of operation. The upper trace 500 shows the intensity of various peaks, most notably, $N^+$ at m/z 14 502, $O^+$ at m/z 16 504, $OH^+$ at m/z 17 506, $H_2O^+$ at m/z 18 508., $Ar^+$ at m/z 40 512, $ArH^+$ at m/z 41 514,$H_2^+$ at m/z 2 516, and $H_3^+$ at m/z 3 518. Two mass spectra recorded with addition of a pressure of about 2 mTorr $H_2$ into the second vacuum region 25 are shown in FIG. 6. The upper trace 600 in FIG. 6 was obtained using the analog mode of operation. The lower trace 610 in FIG. 6 was obtained using the pulse counting mode of operation. The vertical and horizontal scales of FIG. 5 and FIG. 6 are the same. The same ion peaks are labeled in FIG. 6 as in FIG. 5, namely, $N^+$ at m/z 14 602, $O^+$ at m/z 16 604, $OH^+$ at m/z 17 606, $H_2O^+$ at m/z 18 608., $Ar^+$ at m/z 40 612, $ArH^+$ at m/z 41 614,$H_2^+$ at m/z 2 616, and $H_3^{30}$ m/z 3 618.

As the mass spectra in FIG. 5 and FIG. 6 show, this method of implementation allows the direct detection of $H_3^+$ produced in the reaction of $Ar^+$ with $H_2$. The formation of this ion is strongly inferred from the experiments performed in the apparati of the first two embodiments, but $H_3^+$ could not be detected using the Finnigan MAT quadrupole ion trap mass spectrometers. Inasmuch as this method produces a mass spectrum in the same way as a conventional ICP/MS instrument, molecular ions which are commonly observed in conventional ICP/MS, but not by using the methods of the first and second preferred embodiments, may also be observed here. Thus, for example, the effect of elevated $H_2$ pressures in vacuum region 25 on $Ar^+$ may be observed along with the effects on $ArO^+$ and $Ar_2^+$ and other molecular ions. A more detailed view (graphs "blown up" vertically; not shown) of the data in FIGS. 5 and 6 shows that the observed changes in intensity of various molecular ions with $H_2$ added to region 25 is as follows: m/z 14–19 ($N^{30}$ , $O^+$, $OH^+$, $H_2O^+$, and $H_3O^+$) collectively reduced approx. 4-fold, $Ar^+$ reduced approximately 10-fold, $ArH^+$ increased approx. 2-fold, $ArN^+$ and $ArO^+$ reduced approx. 2-fold, and $Ar_2^+$ reduced approx. 5-fold.

The most dramatic effect of added $H_2$ is an approximately 200-fold increase in the intensity of the $H_3^+$ peak 618. Addition of $H_2$ also causes an approximately 10-fold decrease in the intensity of the $Ar^+$ peak 612 and an approximately 2-fold increase in the intensity of the $ArH^+$ peak 614. These mass spectra show minimal reduction (less than 10%) in the intensity of the peaks for other analytes (not shown). These mass spectra thus show a selective removal of $Ar^+$ and an increase in $H_3^+$ thereby confirming the mechanism of charge transfer in the reaction of $H_2$ with $Ar^+$.

Experiment 4

A series of experiments was also performed utilizing the ICP/MS instrument of the third preferred embodiment with no modifications other than adjusting the potentials in the lens stack 60 to reduce the kinetic energy of the ions from typical values under normal operating conditions. $H_2$ was introduced as a reagent gas into the second vacuum region 25 via the vacuum port 400 provided by the manufacturer for pressure measurements. $H_2$ pressures ranged from about 0.1 mTorr to about 1 mTorr. The measured $Ar^+$ intensity was reduced by a factor of two with the introduction of the $H_2$ reagent gas, demonstrating that introduction of $H_2$ into the second vacuum region 25 of an unmodified ICP/MS can be used to reduce the $Ar^+$ ion intensity. We further observed an increase of about a factor of 10 in signal at m/z 41, indicating formation of $ArH^+$ consistent with the experimental observations from the apparatus of the first preferred embodiment.

Table II contains selected data from the experiments performed using the apparatus of the first, second, and third preferred embodiments described herein. Each row of the table gives reduction factors for $Ar^+$ and an analyte ion as well as the ratio of these reduction factors. The ratio is the selectivity with which the $Ar^+$ intensity in the mass spectrum is reduced relative to the intensity of the analyte ion. The entries in the first column in Table II list the preferred embodiment used to obtain the data given in each row. The second column in Table II lists the reagent gas used. The reagent gas was introduced into the quadrupole ion trap for the results shown in Table II for the first preferred embodiment above. The reagent gas was introduced in vacuum region 25 for the results shown in Table II for the second and third embodiments. Thus, by way of example, the third row in Table II shows that the reaction of the carrier gas ion ($Ar^+$) leads to a 30-fold reduction in $Ar^+$ intensity under conditions that reduce the intensity of $Sc^+$ by a factor of two.

TABLE II

| Selectivity of $Ar^+$ Removal | | | | | |
|---|---|---|---|---|---|
| | | Reduction Factors | | | |
| Embodiment | Reagent | Ar+ | Analyte Ion | | Ratio |
| First | $H_2$ | 100,000 | ($In^+$) | <5% | >2,000,000 |
| Second | Ar | 300 | ($Sc^+$) | 7 | ~45 |
| Second | $H_2$ | 30 | ($Sc^+$) | 2 | 15 |
| Third | $H_2$ | 10 | ($In^+$) | <10% | >100 |

THE FOURTH PREFERRED EMBODIMENT

In a fourth preferred embodiment as shown in FIG. 7, the apparatus described in the first preferred embodiment was further modified by incorporating a collision cell 710. The collision cell 710 is formed by enclosing an octopole 720 with a metal tube 730, an entrance aperture 740, and an exit aperture 770. The lens stack 60 of the first preferred embodiment was disassembled so that the collision cell 710 could be inserted. The differential aperture 40 used in previous preferred embodiments was replaced with a entrance aperture 740 with a hole diameter is in the range 1/16" to ½", preferably ¼". The collision cell 710 was inserted between the entrance aperture 740 and the exit aperture 770. The lens element 80 served as a gating electrode to control injection of ions into the trap, although other elements in the ion optics could be used for gating, for example, entrance aperture 740 or exit aperture 770. Installation of the new collision cell 710 and lens stack 750 was accommodated by mounting the lens stack 750 closer to the second aperture 30 (skimmer cone) than in previous embodiments and by mounting the quadrupole ion trap farther from the second aperture 30. The octopole 720 consisted of 2.0 mm diameter S.S. rods, 11.8 cm long, mounted on an inscribed radius of 2.7 mm, although octopoles of other dimensions could be used as well as other RF multipoles, e.g., quadrupoles, hexapoles, dodecapoles, etc.

As is well known, an RF multipole is driven by applying different RF potentials to alternate rods. The potentials applied to the alternate sets of rods have the same voltage and waveform and differ only by a constant phase. The octopole 720 was driven by an RF voltage in the range from about 1 to about 500 $V_{pp}$, preferably about 100 $V_{pp}$. at a frequency in the range 0.1 MHz to 20 MHz, preferably 0.7 5 MHz using a phase difference of 180° between alternate rods. RF multipoles used as ion guides typically also employ a common DC potential applied equally to all rods so as to produce a spatially uniform DC offset component to the guiding field. The octopole 720 was further supplied with such an offset DC voltage in the range from about −200 Volts to about +50 Volts, preferably in the range −20 Volts to +5 Volts.

Buffer and/or reagent gases are admitted into the quadrupole ion trap through a port 90. Buffer and/or reagent gases are admitted into the collision cell through a port 760. A series of experiments was performed utilizing an argon carrier gas and using $H_2$ as reagent gas introduced into the collision cell 710. Mass spectra were obtained for $H_2$ pressures in the third vacuum region 35 between zero and about $10^{-3}$ Torr and are summarized below.

Experiment 5 $Ar^+$+$H_2$

Figure 8:
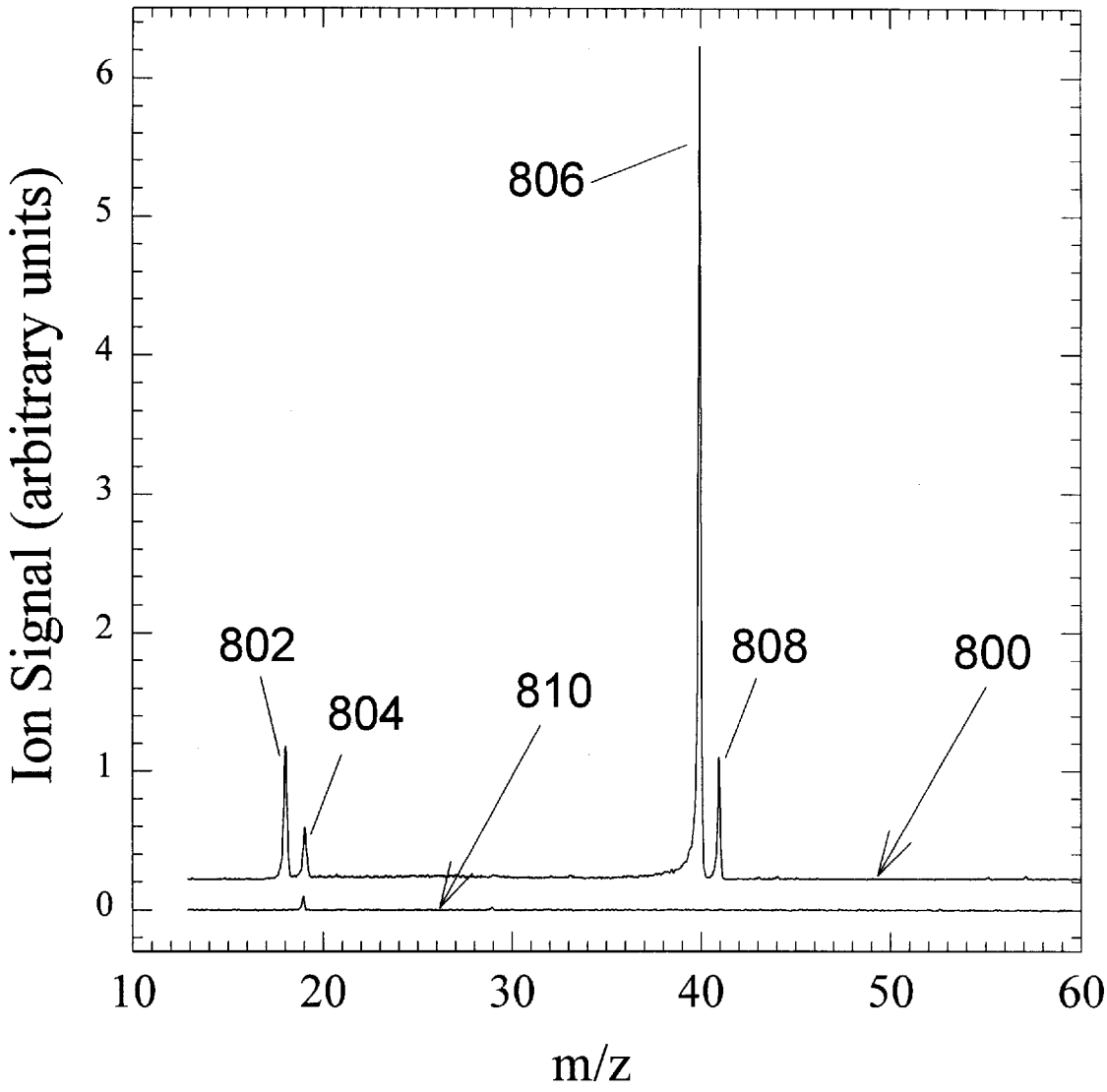
FIG. 8 contains two mass spectra from experiments performed in the apparatus used in the fourth preferred embodiment of the present invention.

The effects on various analyte ion signals and plasma ion signals of $H_2$ added to the collision cell 710 were observed. The mass spectra recorded with and without the addition of $H_2$ into the collision cell 710 are shown in FIG. 8. The upper trace 800 in FIG. 8 was obtained without $H_2$ introduced into the collision cell 710. The lower trace 810 in FIG. 8 was obtained with $H_2$ introduced into the collision cell 710. The upper trace 800 shows the intensity of various peaks, most notably, $H_2O^+$ at m/z 18 802, $H_3O^+$ at m/z 19 804, $Ar^+$ at m/z 40 806, and $ArH^+$ at m/z 41 808. Comparison of the traces 800 and 810 in FIG. 8 shows that introduction of $H_2$ into collision cell 710 reduces the intensities of $H_2O^+$ 802, $Ar^+$ 806, and $ArH^+$ 808 to undetectable levels and also reduces the intensity of $H_3O^+$ 804. Reduction of the intensitiy of the $H_3O^+$ peak 804 is an example of the reduction of a molecular ion by the prior elimination of $Ar^+$.

The analyte sensitivity achieved in the apparatus of the fourth preferred embodiment is the best sensitivity that has been observed. Sensitivity is commonly expressed as a limit of detection (LOD), herein determined in two ways. First, an "instrument" LOD is determined by comparing the analyte signal obtained for a known concentration of analyte in the sample to the standard deviation of the signal in a nearby (within 10 amu/charge) detection channel at mid-mass (i.e., at half-integer mass-to-charge ratio) where the total noise is low. Second, a "method" LOD is determined by comparing the analyte signal for a known concentration of analyte in the sample to the standard deviation of the signal at the same mass-to-charge ratio using a "blank" solution. These LODs are commonly calculated using 3 standard deviations of the background measured in the two ways described. Instrument LODs measured using the apparatus of the fourth preferred embodiment are in the range 0.3 pg/mL to 10 pg/mL. Method LODs are approximately ten times greater than this, i.e., 2 pg/mL to 50 pg/mL.

THE FIFTH PREFERRED EMBODIMENT

Figure 9:
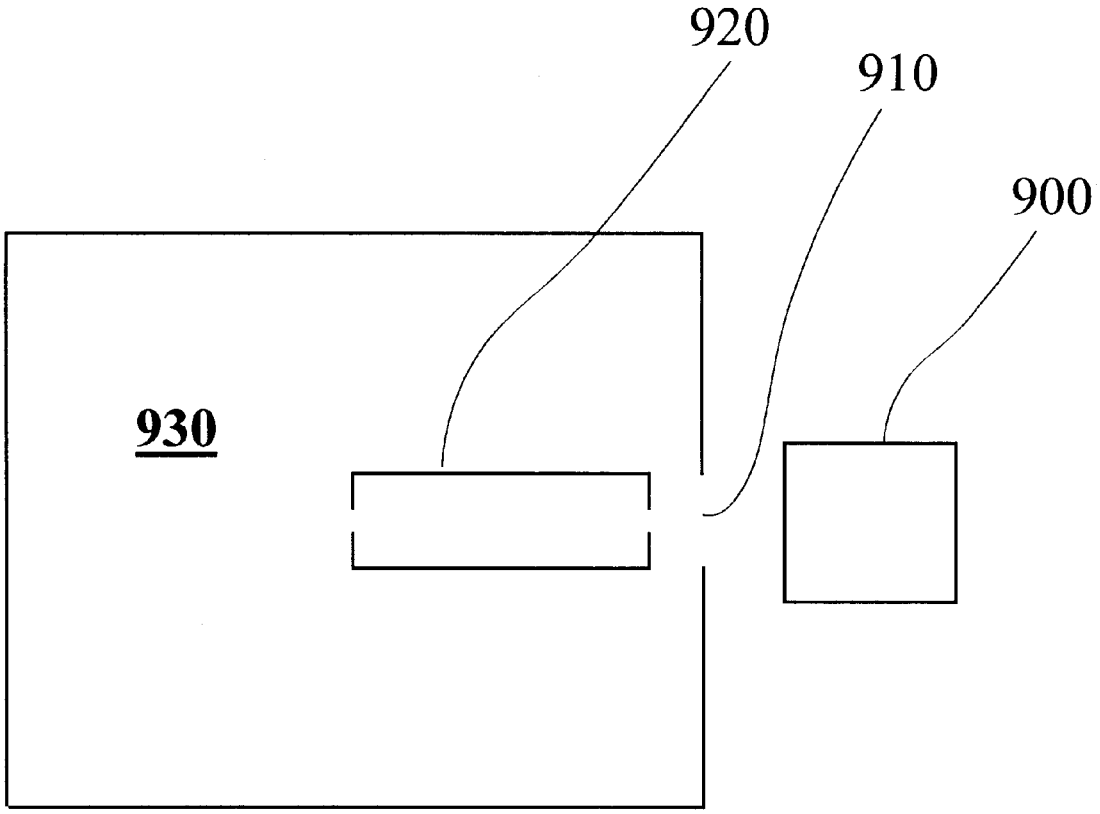
FIG. 9 is a schematic drawing of the apparatus used in the fifth preferred embodiment of the present invention.

In a fifth preferred embodiment as shown in FIG. 9, carrier gas ions and analyte ions generated from an ion source 900 are directed through a first aperture 910 to a collision cell 920 where the ions are allowed to react with a reagent gas. Suitable ion sources include, but are not limited to thermal ionization sources, electron impact, laser irradiation, electrospray, and variations thereof such as Ionspray™, inductively coupled plasma sources, arc/spark discharges, glow discharges, hollow cathode discharges and microwave plasma sources. While the fifth preferred embodiment as described herein is limited to what are considered its essential components, it will be apparent to those skilled in the art that the fifth preferred embodiment could readily be constructed using conventional ICP/MS components as described in prior preferred embodiments. The collision cell 920 is contained within a first vacuum region 930. The collision cell 920 confines ions in a region close to the aperture 910 through which the ions are introduced into the first vacuum region 930. In this manner, ions are directed from the ion source 900 to the collision cell 920 with minimum opportunity for ion dispersion. The first vacuum region 930 contains the collision cell 920 that is made to contain the optimal pressure of reagent gas which allows both ion transport through the collision cell 920 and sufficient charge transfer between the carrier gas ions and the reagent gas.

The collision cell 920 also can be made to control the kinetic energy of the ions. Thus, the collision cell 920 can be used to increase the residence time the carrier gas ions are in contact with the reagent gas and thus to increase the extent of charge transfer. Also, the collision cell 920 can be made to discriminate against, i.e., not transmit, slow ions by application of velocity or kinetic energy discriminating methods, such as the application of suitable DC electric fields. In this manner, charge exchange between fast carrier gas ions and slow reagent gas neutrals can be used to remove selected carrier gas ions from the ion beam. The kinetic energy of the ions in the collision cell 920 is maintained as high as possible so as to minimize space charge expansion of the ions, but low enough for a given pressure of reagent gas to allow sufficient charge transfer. The optimal pressure of the reagent gas will be limited by acceptable analyte ion scattering losses in the cell and practical considerations such as pumping requirements.

As an example, the fifth preferred embodiment may be operated using argon as the carrier gas. The collision cell 920 may be provided as any apparatus suitable for confining the ions in the first vacuum region 930, including but not limited to, a quadrupole ion trap, a long flight tube, a lens stack or an RF multipole ion guide. For example, by selecting the collision cell 920 as an RF multipole ion guide, the collision cell 920 may be operated to selectively disperse reagent gas ions from the ion beam and simultaneously contain and guide analyte ions. By selecting a reagent gas having a low mass, such as $H_2$, the RF multipole ion guide may be operated with a low mass cut-off greater than m/z 3. In this manner, $H_2^+$ and $H_3^+$, which are formed as charge transfer products, are selectively dispersed from the ion beam by virtue of their low m/z.

The resultant ion beam may then be utilized as one of any number of end uses including but not limited to an ion gun or an ion implanter. Further, the resultant beam may be analyzed in various apparatus including but not limited to an optical spectrometer, mass spectrometers (MS), including linear quadrupole MS, quadrupole ion trap MS, ion cyclotron resonance MS, time-of-flight MS, and magnetic and/or electric sector MS, and quadrupole ion trap time-of-flight MS. Finally, the resultant ion beam may be directed through any electrical or magnetic ion focusing or ion directing apparatus, including but not limited to, a lens stack, a wire ion guide, an RF multipole ion guide, an electrostatic sector, or a magnetic sector.

The resultant ion beam thus has an increased proportion of analyte ions compared to carrier gas ions. Thus, in any of the suggested uses wherein the resultant ion beam is directed through an aperture for which the original ion beam current (i.e., the ion beam current prior to selective charge transfer and separation of the charged reagent gas) would meet or exceed the space charge current limit for that aperture, the increased proportion of analyte ions compared to carrier gas ions directed into the aperture will create an increase in the rate at which the analyte ions pass through the aperture. Such an increase in analyte current may also be realized without separating the charged reagent gas if the ion guiding fields that direct ions through the aperture act in a disproportionate fashion with respect to the transmission through the aperture of analyte ions versus other ions in the beam.

Closure

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An apparatus for providing an ion beam in a system where a mixture of carrier gas ions and analyte ions is provided, the apparatus comprising:

(a) an ion source; coupled with (b) a collision cell containing a reagent gas comprising hydrogen wherein said mixture is introduced selectively transferring charge from the carrier gas ions to the reagent gas, thereby neutralizing the carrier gas ions and forming a charged reagent gas.

2. The apparatus as recited in claim 1, wherein said ion source is selected from the group consisting of elemental ion source, molecular ion source and combinations thereof.

3. The apparatus as recited in claim 2, wherein said elemental ion source is selected from the group consisting of inductively coupled plasma, thermal ionization, ion beams, electron impact ionization, laser irradiation, microwave plasma, glow discharge, arc/spark discharge, hollow cathode discharge and combinations thereof.

4. The apparatus as recited in claim 2, wherein said molecular ion source is an electrospray ion source.

5. The apparatus as recited in claim 1, wherein said collision cell is between the first aperture and a second aperture.

6. The apparatus as recited in claim 1, wherein said collision cell is between a second aperture and a lens stack.

7. The apparatus as recited in claim 1, wherein said collision cell is between a lens stack and the mass analyzer.

8. The apparatus as recited in claim 1, further comprising an ion discriminating unit for selectively removing the charged reagent gas from the ion beam.

9. The apparatus as recited in claim 8, wherein the ion discriminating unit is selected from the group comprising a linear rf multipole, a non-linear rf multipole, a quadrupole ion trap, a time-of-flight tube, a combination of a quadrupole ion trap and a time-of-flight tube, a magnetic sector, an electric sector, a combination of a magnetic sector and an electric sector, a lens stack, or a DC voltage plate.

10. The apparatus as recited in claim 1, wherein the hydrogen is in a form selected from the group consisting of $H_2$, $D_2$, HD, and combinations thereof.

11. The apparatus as recited in claim 10, wherein the reagent gas further comprises a gas selected from the group consisting of $N_2$, He, Ne, Ar, Kr, Xe, and combinations thereof.

12. The apparatus as recited in claim 1, wherein the reagent gas is provided as a neutral species of carrier ions, analvte ions, or matrix ions wherein the ions are produced by a method selected from the group consisting of thermal ionization, ion beams, electron impact ionization, laser irradiation, electrospray, thermospray, inductively coupled plasmas, microwave plasmas, glow discharges, arc/spark discharges, and hollow cathode discharges.

13. The apparatus as recited in claim 1, wherein the reagent gas is selected from the group consisting of commercially available substances provided in gaseous form, gases generated by evaporation of condensed substances, gases generated by laser ablation of condensed substances, and mixtures thereof.

14. In an inductively coupled plasma mass spectrometer having an analyte gas and a carrier gas as a mixture, the improvement comprising:

(a) a collision cell containing a reagent gas comprising hydrogen between a first aperture and a mass analyzer wherein said mixture is introduced and selectively transferring charge from carrier gas ions and/or matrix ions to the reagent gas to form charged reagent gas.

15. The spectrometer as recited in claim 14, further comprising an ion discriminating unit for selectively removing the charged reagent gas from an ion beam.

16. The spectrometer as recited in claim 15, the ion discriminating unit is selected from the group consisting of a linear rf multipole, a non-linear rf multipole, a quadrupole ion trap, a time-of-flight tube, a combination of a quadrupole ion trap and a time-of-flight tube, a magnetic sector, an electric sector, a combination of a magnetic sector and an electric sector, a lens stack, or a DC voltage plate.

17. The spectrometer as recited in claim 14, wherein the hydrogen is in a form selected from the group consisting of $H_2$, $D_2$, HD, and combinations thereof.

18. The spectrometer as recited in claim 17, wherein the reagent gas further comprises a gas selected from the group consisting of $N_2$, He, Ne, Ar, Kr, Xe, and combinations thereof.

19. An apparatus for providing an ion beam in a system where a mixture of carrier gas ions and analyte ions is provided, the apparatus comprising:

(a) an ion source; coupled with (b) an ion trap containing a reagent gas comprising hydrogen wherein said mixture is introduced selectively transferring charge from the carrier gas ions to the reagent gas, thereby neutralizing the carrier gas ions and forming a charged reagent gas.

20. The apparatus of claim 19, wherein said ion source is selected from the group consisting of inductively coupled plasma, thermal ionization, ion beams, electron impact ionization, laser irradiation, microwave plasma, arc/spark discharge, hollow cathode discharge, and combinations thereof.

21. An apparatus for providing an ion beam in a system where a mixture of carrier gas ions and analyte ions is provided, the apparatus comprising:

(a) an ion source; coupled with (b) an ion trap containing a reagent gas wherein the reagent gas has a lower molecular weight than that of the carrier gas, and wherein said mixture is introduced selectively transferring charge from the carrier gas ions to the reagent gas, thereby neutralizing the carrier gas ions and forming a charged reagent gas.

22. An apparatus for providing an ion beam in a system where a mixture of carrier gas ions and analyte ions is provided, the apparatus comprising:

(a) an ion source; coupled with (b) a collision cell containing a reagent gas wherein the reagent gas has a lower molecular weight than that of the carrier gas, and wherein said mixture is introduced selectively transferring charge from the carrier gas ions to the reagent gas, thereby neutralizing the carrier gas ions and forming a charged reagent gas.

* * * * *